US008879933B2

(12) United States Patent
Yamamoto

(10) Patent No.: US 8,879,933 B2
(45) Date of Patent: Nov. 4, 2014

(54) IMAGE FORMATION APPARATUS AND METHOD OF ADJUSTING DEVELOPER DISCARD AMOUNT FOR THE SAME

(71) Applicant: Oki Data Corporation, Tokyo (JP)

(72) Inventor: Susumu Yamamoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 76 days.

(21) Appl. No.: 13/833,199

(22) Filed: Mar. 15, 2013

(65) Prior Publication Data

US 2013/0259497 A1 Oct. 3, 2013

(30) Foreign Application Priority Data

Mar. 29, 2012 (JP) ..... 2012-076261

(51) Int. Cl.
*G03G 15/00* (2006.01)
*G03G 21/00* (2006.01)
*G03G 15/08* (2006.01)

(52) U.S. Cl.
CPC ..... *G03G 15/0887* (2013.01); *G03G 21/0005* (2013.01); *G03G 15/50* (2013.01)
USPC ..... 399/43; 399/51; 399/53

(58) Field of Classification Search
USPC ..... 399/38, 43, 51, 53–56
See application file for complete search history.

(56) References Cited

U.S. PATENT DOCUMENTS 7,756,436 B2 * 7/2010 Yamane ..... 399/71
8,515,301 B2 * 8/2013 Niijima ..... 399/53

FOREIGN PATENT DOCUMENTS

JP 2004-125829 A 4/2004

* cited by examiner

*Primary Examiner* — Hoan Tran
(74) *Attorney, Agent, or Firm* — Marvin A. Motsenbocker; Mots Law, PLLC

(57) ABSTRACT

An image formation apparatus includes an exposure unit to form an electrostatic latent image with image dots on a rotatable image carrier by exposing the image carrier to irradiation light, a development unit to form a developer image by attaching a developer to the electrostatic latent image, a voltage supply unit to supply the development unit with a development voltage, a cleaning unit to clean up the developer left on the image carrier after the development, and a developer discard amount controller to control an amount of the developer to be forcibly attached to the image carrier based on a total rotation number of the image carrier if the number of image dots printed during a prescribed number of rotations of the image carrier is smaller than a reference value, and to forcibly attach the controlled amount of the developer to the image carrier to discard the developer.

10 Claims, 11 Drawing Sheets

IMAGE FORMATION APPARATUS ACCORDING TO FIRST EMBODIMENT

FIG.3

58a

TABLE 58a IN FIG. 1

| TOTAL NUMBER OF ROTATIONS N OF DRUM (K) | ROTATION MEASUREMENT VALUE Rf | LIGHT AMOUNT Lf CORRESPONDING TO Rf |
|---|---|---|
| 0 | Rf1 | Lf1 |
| 5 | Rf2 | Lf2 |
| 10 | Rf3 | Lf3 |
| 15 | Rf4 | Lf4 |
| 20 | Rf5 | Lf5 |
| 25 | Rf6 | Lf6 |
| 30 | Rf7 | Lf7 |

FIG.5

PRINT IMAGE QUALITY
CORRESPONDING TO AMOUNT OF TONER TO BE DISCARDED IN FIG. 4

| | DISCARD AMOUNT / EVALUATION ITEM | (1)● NO ADJUSTMENT | (2)○ 0.25mg | (3)△ 0.20mg | (4) * 0.10mg |
|---|---|---|---|---|---|
| a | BLOT | 4 | 4 | 3 | 2 |
| b | OVERLAPPING | 4 | 4 | 3 | 3 |
| c | GRAININESS | 4 | 4 | 3 | 2 |
| d | BLUR | 4 | 4 | 4 | 3 |
| e | GHOST IMAGE | 4 | 4 | 4 | 3 |
| f | DENSITY VARIATIONS | 4 | 4 | 4 | 2 |
| g | STREAK | 4 | 4 | 4 | 3 |
| h | BAND | 4 | 4 | 4 | 3 |
| i | TONER SLIPPAGE | 4 | 5 | 5 | 5 |

IMAGE QUALITY
LEVEL 5 GOOD
LEVEL 4
LEVEL 3
LEVEL 2
LEVEL 1 POOR

IMAGE FORMATION PROCESSING AND TONER DISCARD PROCESSING IN FIG. 1

CONTROL CIRCUIT OF IMAGE FORMATION APPARATUS IN SECOND EMBODIMENT

FIG.9

TABLE 58B IN FIG. 8

58b

| TOTAL NUMBER OF ROTATIONS N OF DRUM (K) | ROTATION MEASUREMENT VALUE Rf | DEVELOPMENT VOLTAGE Vf CORRESPONDING TO Rf |
|---|---|---|
| 0 | Rf1 | Vf1 |
| 5 | Rf2 | Vf2 |
| 10 | Rf3 | Vf3 |
| 15 | Rf4 | Vf4 |
| 20 | Rf5 | Vf5 |
| 25 | Rf6 | Vf6 |
| 30 | Rf7 | Vf7 |

IMAGE FORMATION PROCESSING AND TONER DISCARD PROCESSING IN FIG. 8

IMAGE FORMATION APPARATUS AND METHOD OF ADJUSTING DEVELOPER DISCARD AMOUNT FOR THE SAME

CROSS REFERENCE TO RELATED APPLICATIONS

This application claims priority based on 35 USC 119 from prior Japanese Patent Application No. 2012-076261 filed on Mar. 29, 2012, entitled "IMAGE FORMATION APPARATUS AND METHOD OF ADJUSTING DEVELOPER DISCARD AMOUNT FOR THE SAME", the entire contents of which are incorporated herein by reference.

BACKGROUND OF THE INVENTION

1. Field of the Invention

The disclosure relates to an image formation apparatus such as a printer using an electrophotographic process or a facsimile apparatus, and a method of adjusting a developer discard amount for the same.

2. Description of Related Art

Some image formation apparatuses employ a method in which: a surface of a photosensitive drum is evenly charged by a charging device and is exposed to light by an exposure device to form an electrostatic latent image thereon; a toner image is formed on the photosensitive drum by developing the electrostatic latent image with a development device; and then the toner image is transferred on a recording medium and is further fixed thereon. In such image formation apparatuses, a toner discard operation is carried out for the purpose of suppressing a degradation in print image due to deteriorated toner left on a development roller and maintaining high image quality. As described in Japanese Patent Application Publication No. 2004-125829, for example, a toner discard operation includes discarding deteriorated toner on the development roller by forcibly attaching the toner on the development roller to the photosensitive drum when the number of image dots printed during a prescribed number of rotations of the photosensitive drum is smaller than a predetermined threshold.

SUMMARY OF THE INVENTION

However, when the toner discard operation is carried out in the conventional image formation apparatuses, the amount of toner on the development roller forcibly attached to the photosensitive drum and discarded in one discard operation increases as a total number of rotations of the photosensitive drum increases. This causes a problem in that toner is consumed wastefully.

A first aspect of the invention is an image formation apparatus. The image formation apparatus comprises: a rotatable image carrier configured to carry an electrostatic latent image; an exposure unit configured to form the electrostatic latent image with a certain number of image dots by exposing the image carrier to irradiation light; a development unit configured to form a developer image by attaching a developer to the electrostatic latent image with a development voltage; a voltage supply unit configured to supply the development unit with the development voltage; an image formation unit configured to transfer the developer image onto a recording medium; a cleaning unit configured to clean up the developer left on the image carrier after the transfer of the developer image; and a developer discard amount controller configured to control an amount of the developer to be forcibly attached to the image carrier from the development unit on the basis of a total number of rotations of the image carrier if the number of image dots printed during a prescribed number of rotations of the image carrier is smaller than a reference value, and to forcibly attach a controlled amount of the developer to the image carrier to discard the developer.

A second aspect of the invention is a method of adjusting a developer discard amount for an image formation apparatus. The method includes: forming an electrostatic latent image on an image carrier with a certain number of image dots by exposing the image carrier to irradiation light; forming a developer image by attaching a developer to the electrostatic latent image with a development voltage; transferring the developer image onto a recording medium; cleaning up the excess developer left on the image carrier after the transfer of the developer image; and controlling an amount of the developer to be forcibly attached to the image carrier. The controlling includes: an image dot number judgment step of judging whether or not a number of image dots printed during a prescribed number of rotations of the image carrier is smaller than a reference value; a developer discard amount adjustment step of adjusting an amount of the developer to be forcibly attached to the image carrier from the development unit on the basis of a total number of rotations of the image carrier if a result of the image dot number judgment step is smaller than the reference value; and a developer discard step of discarding the developer in the amount of the developer adjusted in the developer discard amount adjustment step by forcibly attaching the developer to the image carrier.

According to the foregoing aspect (s), the amount of developer to be forcibly attached to the image carrier from the development unit is controlled on the basis of the total number of rotations of the image carrier if the number of image dots printed during the prescribed number of rotations of the image carrier is smaller than the reference value, and the controlled amount of developer is forcibly attached to the image carrier and discarded. Thereby, the amount of developer to be discarded can be adjusted to such a proper amount that the developer will not be discarded excessively while maintaining good print image quality. Thus, the amount of developer discarded can be reduced.

BRIEF DESCRIPTION OF THE DRAWINGS

FIG. 3 is a chart showing an example of first table 58*a* in FIG. 1.

FIG. 5 is a chart showing a result of print image quality evaluation made when the toner discard amount adjustment conditions of FIG. 4 are employed.

FIG. 9 is a chart showing an example of table 58*b* in FIG. 8.

DETAILED DESCRIPTION OF EMBODIMENTS

Figure 1:
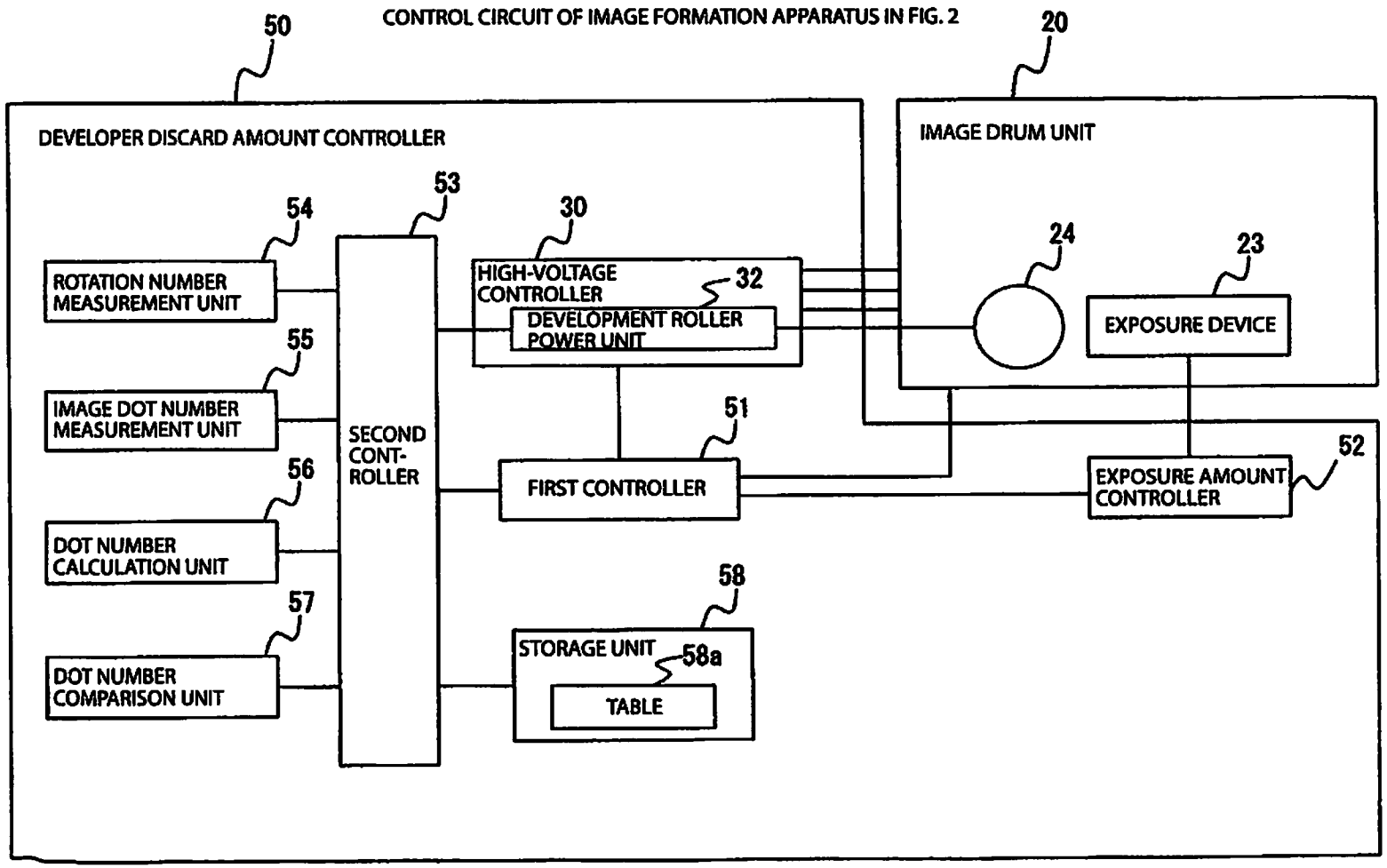
FIG. 1 is a block diagram schematically showing a control circuit of an image formation apparatus shown in FIG. 2.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Modes for carrying out the invention become clear by reading the following description of preferred embodiments with reference to the accompanying drawings. It should be noted, however, that the drawings are provided merely for an illustrative purpose and are not intended to limit the scope of the invention.

First Embodiment (Configuration of First Embodiment)

Figure 2:
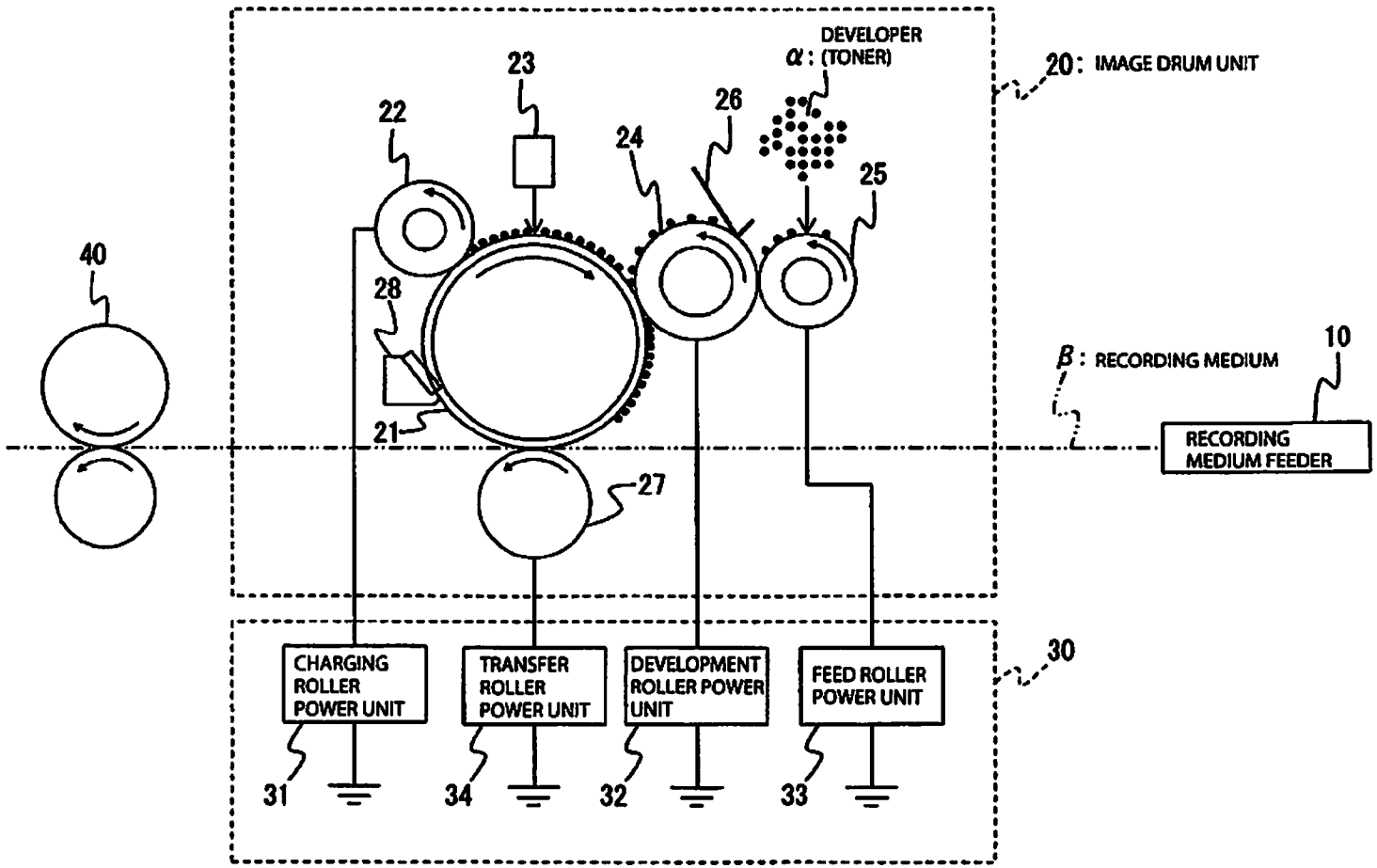
FIG. 2 is a diagram showing a schematic structure of the image formation apparatus according to a first embodiment of the invention.

FIG. 2 is a diagram showing a schematic structure of an image formation apparatus according to a first embodiment of the invention.

The image formation apparatus is a printer using an electrophotographic process, for example. The image formation apparatus includes recording medium feeder 10 configured to feed recording medium β for image formation such as a paper sheet. Image drum unit 20 is provided downstream of recording medium feeder 10, and is connected to high-voltage controller 30. Fixing roller 40 is provided downstream of image drum unit 20.

Image drum unit 20 includes: photosensitive drum 21 as an image carrier; charging roller 22; exposure device 23 as an exposure unit; development roller 24 as a development unit; feed roller 25 as a developer feed unit; development blade 26 as a developer regulation unit; transfer roller 27 as a transfer unit; cleaning device 28 as a cleaning unit; and toner α as a developer.

Photosensitive drum 21 is a rotatable member configured to carry an electrostatic latent image, and includes: a conductive support; and a photoconductive layer provided on a surface of the conductive support. The conductive support is formed using a metal pipe made of aluminum, and the photoconductive layer is formed using an organic photoreceptor made by sequentially stacking a charge generation layer and a charge transport layer. Charging roller 22 is configured to form an electrostatic latent image on photosensitive drum 21, and includes: a metal shaft; and a semiconductive rubber layer provided on a surface of the metal shaft. Development roller 24 is a development member configured to form a toner image as a developer image by attaching toner to an electrostatic latent image, which is formed on photosensitive drum 21, by means of a development voltage, and includes: a metal shaft; and a semiconductive material provided on a surface of the metal shaft, the semiconductive material being a material with a moderate elasticity such as a semiconductive urethane rubber material. Feed roller 25 is configured to feed toner α to development roller 24.

Development blade 26 is configured to make uniform the thickness of toner α on development roller 24. For example, development blade 26 is 0.08 mm in thickness and formed of such a stainless steel thin plate that its length in a longitudinal direction is substantially equal to the width of the elastic body of development roller 24. The stainless steel thin plate has one end in the longitudinal direction fixed to an unillustrated frame, and the other end in the longitudinal direction has a bent portion at its tip end. The stainless steel thin plate is disposed in such a manner that a portion of its surface slightly forward of the tip of the bent portion is in contact with a surface of development roller 24.

Transfer roller 27 is disposed under photosensitive drum 21, and is configured to move recording medium β from right to left, as well as to transfer a toner image of photosensitive drum 21 on recording medium β by means of a transfer voltage. Fixing roller 40 is configured to fix a toner image transferred on recording medium β, which is ejected by the rotation of photosensitive drum 21 with transfer roller 27, in order to form an image. Cleaning device 28 is configured to clean photosensitive drum 21 by scraping off toner α left on photosensitive drum 21 after a toner image is transferred on recording medium β.

High-voltage controller 30 is configured to control the turn-on and turn-off of, and a value of, a voltage applied to each of charging roller 22, development roller 24, feed roller 25, and transfer roller 27. High-voltage controller 30 has such a configuration that charging roller power unit 31, development roller power unit 32 as a voltage supply unit, feed roller power unit 33, and transfer roller power unit 34 are connected to charging roller 22, development roller 24, feed roller 25, and transfer roller 27, respectively.

Charging roller power unit 31 is configured to output a bias voltage with the same polarity as that of the toner to charging roller 22. Development roller power unit 32 is configured to output any one of a bias voltage with the same polarity as that of the toner and a bias voltage with an opposite polarity from that of the toner to development roller 24 as development voltage Vf. Feed roller power unit 33 is configured to output any one of a bias voltage with the same polarity as that of the toner and a bias voltage with an opposite polarity from that of the toner. Transfer roller power unit 34 is configured to supply a transfer voltage to transfer roller 27.

FIG. 1 is a block diagram schematically showing a control circuit of the image formation apparatus shown in FIG. 2.

The control circuit of the image formation apparatus includes image drum unit 20 and developer discard amount controller 50.

Image drum unit 20 includes exposure device 23, development roller 24, and the like. Exposure device 23 and development roller 24 are respectively connected to exposure amount controller 52 and development roller power unit 32 inside developer discard amount controller 50.

Developer discard amount controller 50 includes: development roller power unit 32; first controller 51; exposure amount controller 52 as a light amount change unit; second controller 53; rotation number measurement unit 54; image dot number measurement unit 55; dot number calculation unit 56; dot number comparison unit 57; and storage unit 58.

First controller 51 is configured to control the overall image formation operation. First controller 51 is configured to control the rotation operation, such as the turn-on and turn-off, of photosensitive drum 21, charging roller 22, development roller 24, feed roller 25, and transfer roller 27 as well as to control the turn-on and turn-off of and a value of a voltage to be applied to each of charging roller 22, development roller 24, feed roller 25, and transfer roller 27. In addition, first controller 51 is connected to exposure amount controller 52 and configured to output a control signal to exposure amount controller 52. Exposure amount controller 52 is configured to control light amount Lf of irradiation light to be emitted from exposure device 23, in accordance with a control signal from first controller 51.

Second controller 53 is configured to control the overall operation of developer discard amount controller 50 while the image formation operation is stopped. Second controller 53 is configured to obtain a reducible amount of toner α which may otherwise be discarded by being forcibly attached to photosensitive drum 21 from development roller 24, on the basis of total number of rotations N of photosensitive drum 21, when dot number calculation result D3 is smaller than predetermined reference value Df. Second controller 53 is also configured to control light amount Lf of irradiation light to be emitted from exposure device 23 by way of first controller 53, so that the amount of toner α discharged may be reduced by the obtained amount. Second controller 53 is connected to rotation number measurement unit 54, image dot number measurement unit 55, dot number calculation unit 56, dot number comparison unit 57, and storage unit 58.

Rotation number measurement unit 54 is configured to measure total number of rotations N of photosensitive drum 21 from the start of use, and to output rotation measurement value Rf thus measured to dot number calculation unit 56. Image dot number measurement unit 56 is configured to measure the number of image dots, which indicates the number of light beams emitted from exposure device 23 for exposure, and to output the dot measurement value thus measured to dot number calculation unit 56.

Dot number calculation unit 56 is configured to calculate the number of image dots printed during a prescribed number of rotations Pt of photosensitive drum 21, determined in advance, from rotation measurement value Rf outputted from rotation number measurement unit 54 and the dot measurement value outputted from image dot number measurement unit 55, and to output dot number calculation result D3 to dot number comparison unit 57. Dot number comparison unit 57 is configured to compare dot number calculation result D3 inputted by dot number calculation unit 56 with dot number Df predetermined corresponding to the prescribed number of rotations of photosensitive drum 21, and to output the comparison result to second controller 53. Storage unit 58 is configured to store therein data, such as dot number Df, printed during the prescribed number of rotations of photosensitive drum 21 which is used by dot number comparison unit 57. Storage unit 58 also stores first table 58*a* which is referred to when the amount of toner to be discarded is adjusted.

FIG. 3 is a chart showing an example of first table 58*a* in FIG. 1.

In first table 58*a*, total number of rotations N of photosensitive drum 21, rotation measurement value Rf associated with total number of rotations N, and light amount Lf of irradiation light of exposure device 23 associated with rotation measurement value Rf are stored. In FIG. 3, unit K for total number of rotations N of photosensitive drum 21 represents 1000.

Rotation measurement values Rf in FIG. 3 have a magnitude relation of Rf1<Rf2<Rf3<Rf4<Rf5<Rf6<Rf7. Meanwhile, amounts of light Lf in FIG. 3 have a magnitude relation of Lf7<Lf6<Lf5<Lf4<Lf3<Lf2<Lf1. A setting is made in such a manner that, as rotation measurement value Rf associated with total number of rotations N of photosensitive drum 21 increases, light amount Lf of irradiation light to be emitted from exposure device 23 becomes smaller. Rotation measurement value Rf in FIG. 3 has seven levels, i.e., Rf 1 to Rf 7, but in practical use, rotation measurement value Rf has multiple levels corresponding to total number of rotations N of photosensitive drum 21. The same applies for light amount Lf.

(Operation of First Embodiment)

An operation of the image formation apparatus according to the first embodiment is described in three chapters: (I) Schematic Image Formation Operation; (II) Detailed Image Formation Operation; and (III) Operation of Toner discard processing.

(I) Schematic Image Formation Operation

In FIG. 2, a surface of photosensitive drum 21 is evenly charged by charging roller 22 which is charged with a charging voltage supplied by charging roller power unit 31. Photosensitive drum 21 evenly charged by charging roller 22 is rotated clockwise, and then irradiated with irradiation light from exposure device 23. This removes the electric charges on photosensitive drum 21 in an image formation portion or in a portion other than this image formation portion, so that an electrostatic latent image is formed. Photosensitive drum 21 on which the electrostatic latent image is formed is further rotated clockwise. At a position where photosensitive drum 21 is brought into contact with development roller 24, toner α on development roller 24 is attached to the electrostatic latent image on photosensitive drum 21 with development voltage Vf which is applied by development roller power unit 32 controlled by high-voltage controller 30, so that a toner image is formed on photosensitive drum 21. Photosensitive drum 21 on which the toner image is formed is further rotated clockwise. In a nip portion between photosensitive drum 21 and transfer roller 27, the toner image is transferred on recording medium β fed by recording medium feeder 10. Recording medium β on which the toner image is transferred is heated and pressurized by fixing roller 40 disposed at the left of image drum unit 20. Thereby, the toner image is fixed on recording medium β and the image is formed thereon. After that, cleaning device 28 cleans up photosensitive drum 21 by scraping off toner α left on photosensitive drum 21 after the toner image is transferred on recording medium β.

(II) Detailed Image Formation Operation

In FIGS. 1 and 2, first controller 51 controls the turn-on and turn-off of charging roller 22, photosensitive drum 21, development roller 24, feed roller 25, and transfer roller 27 in image drum unit 20. The peripheral velocity ratio in rotation among charging roller 22, photosensitive drum 21, development roller 24, feed roller 25, and transfer roller 27 and the linear velocity of the rotation of each of these rollers are determined by the ratio among the outer diameters of these rollers. Photosensitive drum 21 has an outer diameter of 30ϕ, development roller 24 has an outer diameter of 16ϕ, and feed roller 25 has an outer diameter of 15.5ϕ. The peripheral velocity ratio of development roller 14 to photosensitive drum 21 is 1.35 and the peripheral velocity ratio of feed roller 25 to development roller 24 is 0.67. The linear velocity of photosensitive drum 21 in an ON state is 160 mm/sec. In addition, first controller 51 controls a value and an output timing of a voltage outputted from each of charging roller power unit 31, development roller power unit 32, feed roller power unit 33, and transfer roller power unit 34 in high-voltage controller 30.

In FIG. 2, the surface of photosensitive drum 21 is charged at about −1000 V by charging roller 22 connected to charging roller power unit 31. First controller 51 also controls exposure device 23, which is configured to emit light-emitting diode (hereinafter referred to as "LED") light or laser light as irradiation light, on the basis of image data outputted from an unillustrated write controller, and forms an electrostatic latent image on the surface of photosensitive drum 21 on the basis of the image data. Exposure amount controller 52 controls, to a proper value, light amount Lf of irradiation light emitted from exposure device 23.

Feed roller 25 connected to feed roller power unit 33 is in contact with development roller 24 connected to development roller power unit 32, and is driven to rotate so to feed toner α to development roller 24. Toner α on development roller 24 is charged by the friction of toner α against feed roller 25 and development blade 26 which are in contact with development roller 24. The thickness of a toner α layer on development roller 24 is determined by the pressing force of and the contact angle of development blade 26 against development roller 24, for example.

Development roller 24 attaches toner α on an electrostatic latent image on photosensitive drum 21 by application of development voltage Vf by development roller power unit 32, and thus forms a toner image on photosensitive drum 21. The toner image on photosensitive drum 21 is then rotated clockwise together with photosensitive drum 21. In the nip portion between photosensitive drum 21 and transfer roller 27, the toner image is transferred onto recording medium β fed by recording medium feeder 10. After that, the toner image on recording medium β is heated and pressurized by fixing roller 40 disposed at the left of image drum unit 20 and is fixed on recording medium β. Thereby, the image is formed on recording medium β on the basis of the image data.

(III) Operation of Toner Discard Processing

In FIG. 2, when toner α passes through a pressure contact portion of development roller 24 with feed roller 25 or photosensitive drum 21, toner α receives a frictional force from the counterpart component or neighboring toner α, and thereby deteriorates with time due to a loss of a charge control agent added to the surface of toner α or the like. In the case where the number of image dots printed during total number of rotations N of photosensitive drum 21 is small, the amount of toner α attached to photosensitive drum 21 from development roller 24 in the development operation is small. As a result, toner α deteriorated through the development operation is left on development roller 24. If deteriorated toner α is left on development roller 24, deteriorated toner α left on development roller 24 is attached to photosensitive drum 21 when a toner image is formed on photosensitive drum 21 in the image formation operation. As a consequence, an image printed on recording medium β is deteriorated.

To cope with this, in the case where the number of image dots printed during a prescribed total number of rotations of photosensitive drum 21 (hereinafter referred to as "prescribed number of rotations") set in advance is smaller than a predetermined reference value, toner discard processing for discarding toner α left on development roller 24 and deteriorated through the development operation is carried out by forcibly attaching the deteriorated toner to photosensitive drum 23. Part of deteriorated toner α is transferred onto recording medium β and consumed during the image formation, but the rate of deteriorated toner α left on development roller 24 increases if the number of image dots printed during total number of rotations N of photosensitive drum 21 is small. Thus, deteriorated toner α is positively discarded through the toner discard processing in order to prevent deterioration of image quality.

Figure 4:
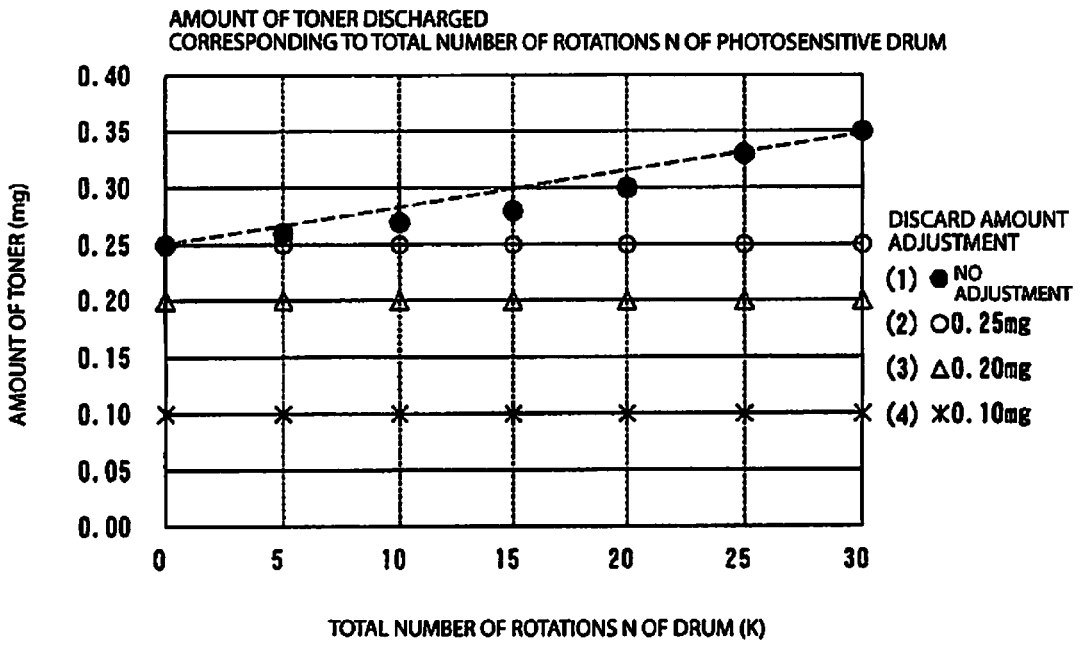
FIG. 4 is a graph showing a measurement result of the amount of toner discharged on a photosensitive drum in one toner discard operation corresponding to total number of rotations N of the photosensitive drum.

FIG. 4 is a graph showing a measurement result of the amount of toner discharged on photosensitive drum 21 in one toner discard operation corresponding to total number of rotations N of photosensitive drum 21. In FIG. 4, (1) ● shows the case where the amount of toner to be discharged is not adjusted, (2) ○ shows the case where the amount of toner to be discharged is adjusted to a constant amount of 0.25 mg, (3) Δ shows the case where the amount of toner to be discharged is adjusted to a constant amount of 0.20 mg, and (4) * shows the case where the amount of toner to be discharged is adjusted to a constant amount of 0.10 mg.

In this measurement result, the horizontal axis indicates total number of rotations N of photosensitive drum 21 (for example, its lifetime number of rotations of 30,000), and the vertical axis indicates the amount of toner discharged on photosensitive drum 21 in one toner discard operation. The toner discard operation is carried out when the rate of the area of an image printed on recording medium β with respect to the prescribed number of rotations of photosensitive drum 21 is equal to or lower than 2.0%. FIG. 4 shows a measurement result in the case where an image having this image area rate of 0.3% is repeatedly printed.

In the toner discard operation with an exposure amount of 50%, toner α is discharged in an amount left on the circumferential length of development roller 24 in a sub-scanning direction. In this event, development roller 24 is applied with a development voltage of −150 V whereas transfer roller 27 is applied with a voltage of 0 V. This means that almost all of toner α discharged on photosensitive drum 21 is cleaned up by cleaning device 28.

FIG. 4 shows that, in the case where the amount of toner to be discharged is not adjusted, the amount of toner to be discarded in one discard operation increases as total number of rotations N of photosensitive drum 21 increases ((1) ●). This indicates that the amount of toner to be discarded correlates with the lifetime of image drum unit 20. Factors determining the lifetime of image drum unit 20 include the abrasion of photosensitive drum 21, the clogging of toner in feed roller 25, and the abrasion of development blade 26. That is, as image drum unit 20 gets closer to the end of its life, the amount of toner to be discarded to photosensitive drum 21 in one toner discard operation increases due to the above factors. This means that a larger amount of toner α, which actually does not need to be discarded, is discarded and wasted as image drum unit 20 gets closer to the end of its life.

(2) to (4) in FIG. 4 show results of adjusting the amount of toner to be discharged in such a manner that the amount of toner to be discarded is always constant irrespective of total number of rotations N of photosensitive drum 21. As in the case of (1) above, the results of (2) to (4) are acquired under such an evaluation condition where an image having the image area rate of 0.3% is repeatedly printed.

FIG. 5 is a chart showing a result of print image quality evaluation made when the toner discard amount adjustment conditions of FIG. 4 are employed.

In FIG. 5, evaluation items for print image quality evaluation (for example, nine evaluation items including blot a, overlapping b, graininess c, blur d, ghost image e, density variations f, streak g, band h, and toner slippage i) each having five levels 1 to 5 are used for grading. (1) to (4) in FIG. 5 respectively correspond to (1) to (4) in FIG. 4, and show how the result of print image quality evaluation changes depending on a difference in the amount of toner to be discharged. Further, Levels 1 to 5 represent quality levels of each quality evaluation item, and a level closer to Level 5 represents a better result. Here, while the result of quality evaluation in the case of (1) no adjustment is set at a reference value=Level 4, the printing results in the case of (2) to (4) are graded in five levels relative to the reference value.

The results of (1) and (2) in FIG. 5 show that (1) and (2) have the same level of Level 4 in the eight evaluation items a to h, although not for one evaluation item, i.e., toner slippage I, and thus have no difference in the quality evaluation level.

This leads to the following result. In the case where no adjustment is made to the amount of toner to be discarded, a larger amount of toner α, which actually does not need to be discarded, is discarded and wasted as image drum unit 20 gets closer to the end of its life. On the other hand, in the case where the amount of toner to be discarded is adjusted to a constant amount of 0.25 mg, it is possible to reduce the amount of toner α by the amount obtained by subtracting the amount of toner at Plot ○ from the amount of toner at Plot ● in FIG. 4.

In addition, the results of (2) to (4) in FIG. 5 show that the evaluation levels in the quality evaluation items such as blot a, overlapping b, and graininess c decrease when the amount of toner discharged is too small. In sum, the amount of toner to be discharged in the toner discard operation needs to be set at a certain amount, but the amount of toner to be discarded which increases in proportion to total number of rotations N of photosensitive drum 21 needs to be adjusted.

Figure 6:
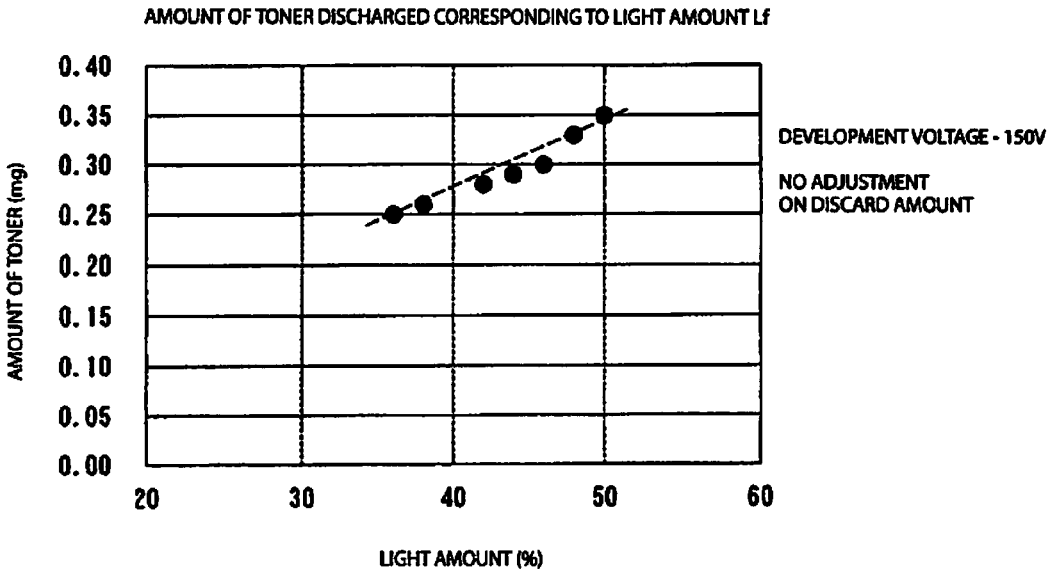
FIG. 6 is a graph showing a result of measuring the amount of toner discharged on the photosensitive drum in one toner discard operation when light amount Lf from an exposure device is changed.

FIG. 6 is a graph showing a result of measuring the amount of toner discharged on the photosensitive drum in one toner discard operation when light amount Lf of irradiation light from exposure device 23 is changed.

This graph shows the result of the amount of toner discharged in the case where the horizontal axis indicates light amount Lf (%) of irradiation light from exposure device 23 and the vertical axis indicates the amount of toner (mg) discharged on photosensitive drum 21 in one toner discard operation. As can be understood from FIG. 6, the smaller light amount Lf is, the smaller the amount of toner discharged in one toner discard operation is. Setting light amount Lf smaller makes it possible to reduce the amount of toner discharged on photosensitive drum 21 in one toner discard operation because this reduces a potential difference between an electrostatic latent image on photosensitive drum 21 and development roller 24.

In the first embodiment, an adjustment is made such that light amount Lf of irradiation light from exposure device 23 is reduced along with an increase of total number of rotations N of photosensitive drum 21, thereby reducing the amount of toner discarded wastefully, which increases in proportion to total number of rotations N of the photosensitive drum.

With reference to FIGS. 4 to 6, a description is given here of how to obtain rotation measurement value Rf and light amount Lf corresponding to rotation measurement value Rf in table 58*a* in FIG. 1 shown in FIG. 3, which are determined by total number of rotations N of photosensitive drum 21.

In FIG. 3, when total number of rotations N of photosensitive drum 21 is 15 (K)=15,000, rotation measurement value Rf=Rf4 and light amount Lf=Lf4.

In FIG. 4, when total number of rotations N of photosensitive drum 21 is 15 (K), the amount of toner discharged in one discard operation in the case where no adjustment is made to the discard amount ((1) ●) is 0.28 (mg). As compared with the case where the amount of toner to be discharged is adjusted to a constant amount of 0.25 mg ((2) ○), which has no difference from the case of no adjustment ((1) ●) in print image quality, it shows that toner α is discarded excessively in the case of no adjustment ((1) ●) by the amount (per discard operation) equal to:

$$0.28\ (\text{mg})-0.25\ (\text{mg})=0.03\ (\text{mg}).$$

For instance, assuming that the amount of irradiation light from exposure device 23 in the case of no adjustment ((1) ●) in FIG. 4 is 50(%), it can be understood from FIG. 6 that the amount of toner to be discharged in one discard operation can be adjusted to be smaller by 0.03 (mg) by lowering light amount Lf (%) of irradiation light from exposure device 23 from 50(%) to 48(%). To put it differently, a reducible amount of toner, which is discharged excessively, in certain total number of rotations N of photosensitive drum 21 is obtained from FIG. 4, and then light amount Lf (%) needed to be reduced to reduce the amount of toner by the obtained reducible amount is obtained from FIG. 6.

As described above, light amount Lf (%) corresponding to total number of rotations N of photosensitive drum 21 (K) is obtained and stored in table 58*a* of FIG. 3 in advance. Then, in the toner discard operation, light amount Lf (%) associated with certain total number of rotations N of photosensitive drum 21 (K) is read from the table, and light amount Lf (%) of irradiation light to be emitted from exposure device 23 is controlled by exposure amount controller 52 so that light amount Lf may become equal to read light amount Lf (%). Thereby, the amount of toner discharged excessively can be reduced while the print image quality in this case is kept equal to that in the case where the amount of toner to be discharged is not adjusted.

Figure 7:
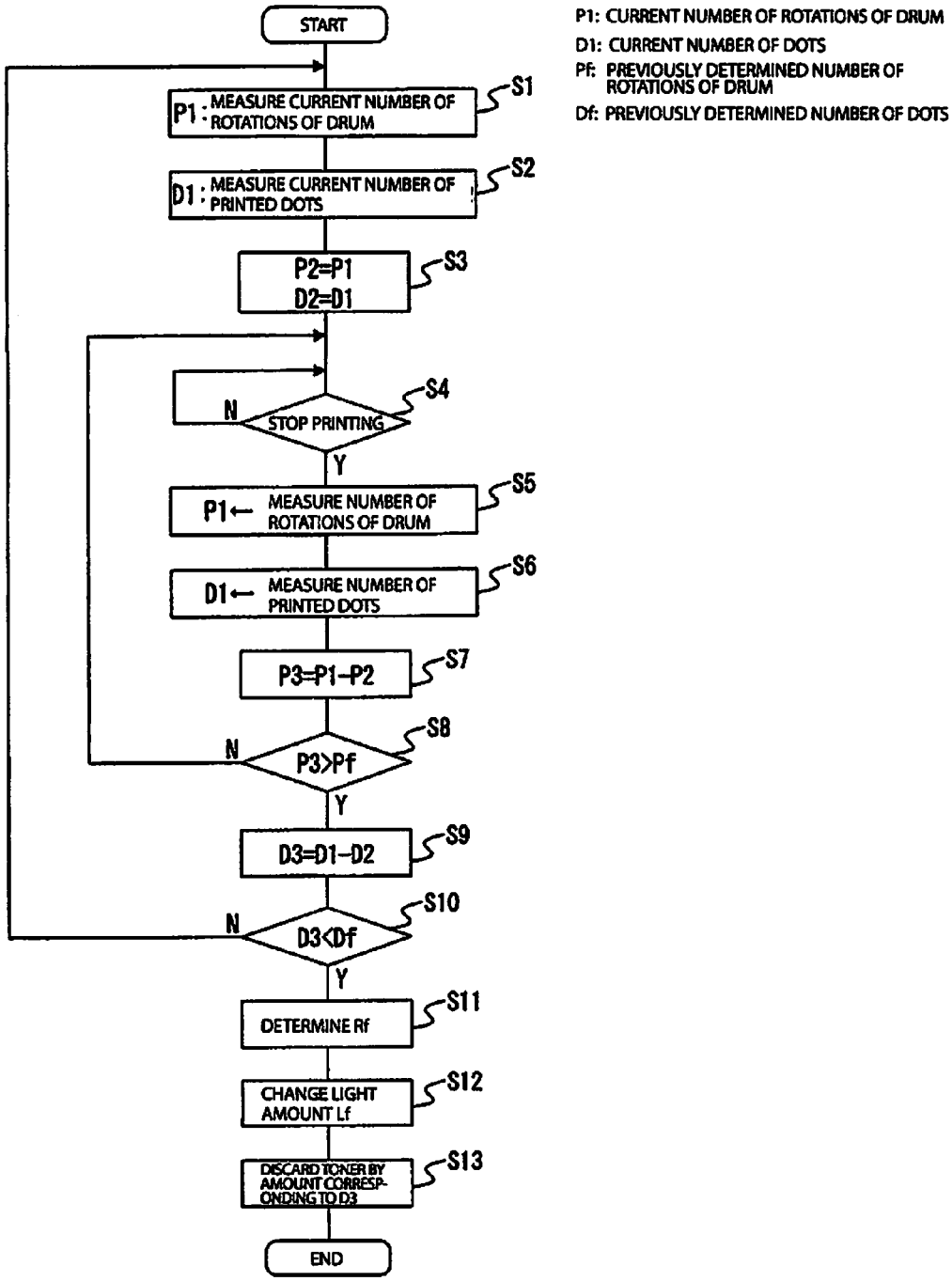
FIG. 7 is a flowchart showing image formation processing and toner discard processing by the control circuit shown in FIG. 1 of the image formation apparatus.

FIG. 7 is a flowchart showing the image formation processing and the toner discard processing in the image formation apparatus of FIG. 2.

Based on FIG. 7, a description is given of operations of the image formation processing and the toner discard processing in the image formation apparatus of FIG. 2 with reference to FIGS. 1 to 3. In FIG. 7, Step S10 indicates image dot number judgment processing, Steps S11 and S12 indicate developer discard amount adjustment processing, and Step S13 indicates developer discard processing.

Once started, the process moves to Step S1. In Step S1, rotation number measurement unit 54 constantly measures a current number of rotations of the drum as P1, and the process moves to Step S2. In Step S2, image dot number measurement unit 55 constantly measures a current number of printed dots as D1, and the process moves to Step S3. Here, each of the current number of rotations P1 of the drum and the current number of image dots D1 in Steps S1 and S2 is a value accumulated from the start of use of image drum unit 20. The measured values are outputted to second controller 53 and stored in storage unit 58.

In Step S3, the current number of rotations P1 of the drum and the current number of image dots D1 are outputted to second controller 53. Second controller 53 stores, in storage unit 58, the current number of rotations P1 of the drum as P2 and the current number of image dots D1 as D2, and the process moves to Step S4. In Step S4, second controller 53 monitors the printing operation from the start to the stop of rotation of photosensitive drum 23. Second controller 53 starts monitoring once photosensitive drum 23 starts rotation, and continues the monitoring until the printing is stopped. Once second controller 53 recognizes the stop of the printing (Y), the process moves to Steps S5 and S6. In Steps S5 and S6, second controller 53 instructs rotation number measurement unit 54 and image dot number measurement unit 55 to output a current number of rotations P1 of the drum and a current number of printed dots D1 to dot number calculation unit 56. The values measured by rotation number measurement unit 54 and image dot number measurement unit 55 at this time are outputted to second controller 53 and stored in storage unit 58.

In Step S7, dot number calculation unit 56 receives, from second controller 53, the current number of rotations P2 of the drum and the current number of printed dots D2 stored in storage unit 58. Then, dot number calculation unit 56 calculates the number of rotations of the drum from the start to the stop of printing P3 (=P1−P2) and outputs it to second controller 53, and the process moves to Step S8. In Step S8, second controller 53 compares the number of rotations of the drum from the start to the stop of printing P3 with number of rotations Pf of the drum previously stored in storage unit 58. If the number of rotations of the drum from the start to the stop of printing P3 is larger than the previously stored number of rotations Pf of the drum (Y), the process moves to Step S9. If the number of rotations of the drum from the start to the stop of printing P3 is equal to or smaller than the previously stored number of rotations Pf of the drum (N), the process goes back to Step S4. In Step S9, second controller 53 instructs dot number calculation unit 56 to calculate the number of image dots from the start to the stop of printing D3 (=D1−D2) and output it to dot number comparison unit 57, and the process moves to Step S10. In Step S10, dot number comparison unit 57 compares the magnitude of the number of image dots from the start to the stop of printing D3 with that of number of image dots Df previously stored in storage unit 58. If the number of image dots from the start to the stop of printing D3 is smaller than the previously stored number of image dots Df (Y), the process moves to Step S11. If the number of image dots from the start to the stop of printing D3 is equal to or larger than the previously stored number of image dots Df (N), the process goes back to Step S1.

Here, the above description means that, if D3<Df, the toner discard operation is carried out in Steps S11 to S13. If D3≥Df, the processing in Steps S1 to S10 is repeated, i.e., only the image formation processing is carried out and no toner discard operation is carried out.

In Step S11, second controller 53 determines rotation measurement value Rf associated with the current number of rotations P1 of the drum with reference to table 58*a* stored in storage unit 58, and the process moves to Step S12. In Step S12, with reference to table 58*a* stored in storage unit 58, second controller 53 determines light amount Lf associated with rotation measurement value Rf determined in Step S11. Light amount Lf thus determined is inputted in exposure amount controller 52, and the process moves to Step S13. In Step S13, while irradiation light is emitted from exposure device 23 with light amount Lf determined in Step S12, second controller 53 carries out the toner discard operation in which deteriorated toner α on development roller 24 is forcibly attached to photosensitive drum 21 and discarded. Thus, the process is terminated.

(Effect of First Embodiment)

According to the image formation apparatus and the method of adjusting a developer discard amount for the same in the first embodiment, in the toner discard operation, light amount Lf (%) of irradiation light to be emitted from exposure device 23 is controlled on the basis of total number of rotations N of photosensitive drum 21, and thereby the amount of toner α on development roller 24 to be forcibly attached to photosensitive drum 21 is adjusted. With the apparatus and method, no toner is discarded excessively, and thus it is possible to reduce the amount of toner to be discarded while maintaining good print image quality. Besides, the amount of toner filled in image drum unit 20 prior to shipment of the unit (or image formation apparatus) can be reduced, and the cost of manufacture of image drum unit 20 can be reduced by this toner reduction.

Second Embodiment (Configuration of Second Embodiment)

Figure 8:
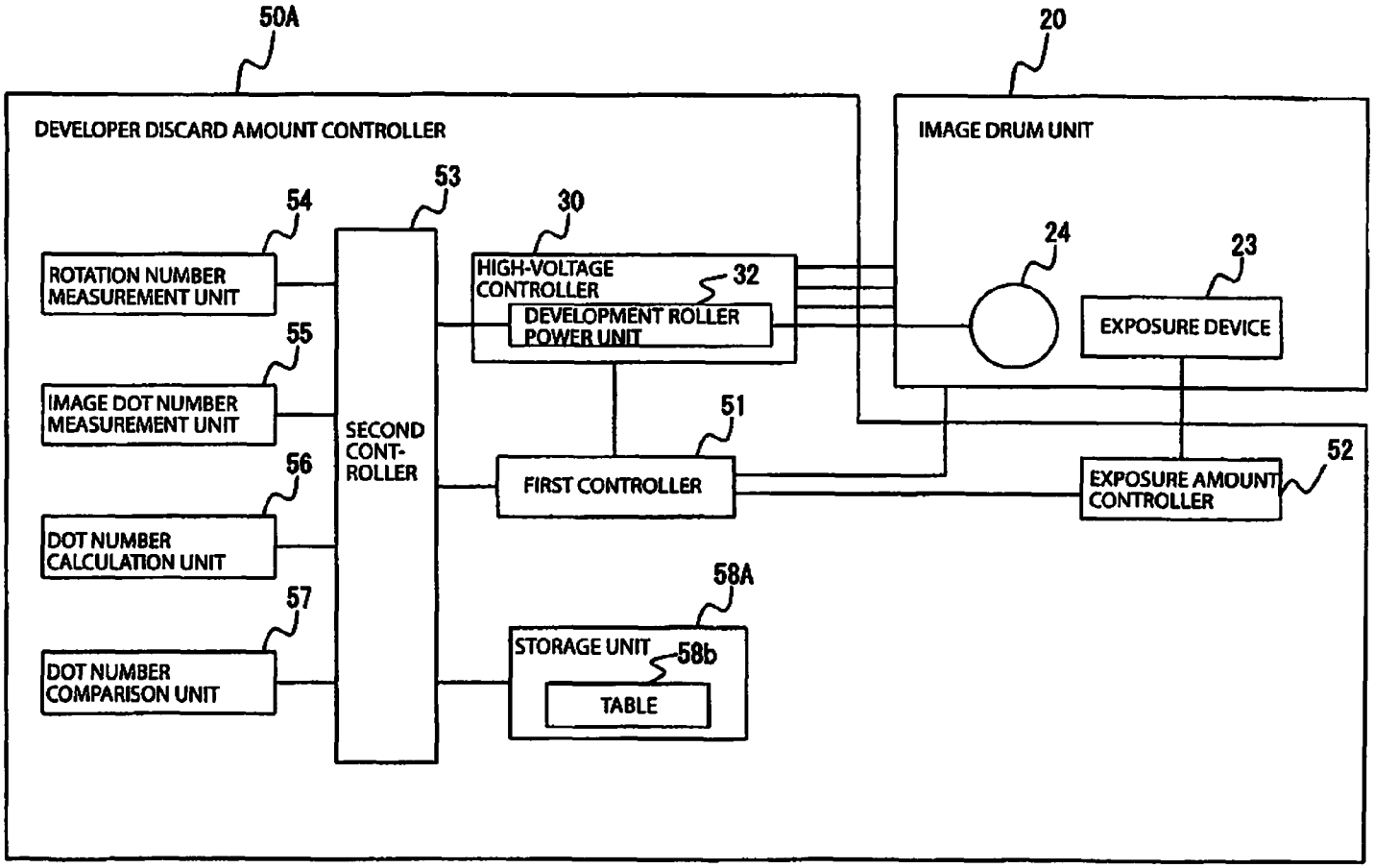
FIG. 8 is a block diagram schematically showing a control circuit of an image formation apparatus according to a second embodiment of the invention.

FIG. 8 is a block diagram schematically showing a control circuit of an image formation apparatus according to a second embodiment of the invention. Components in FIG. 8 which are the same as those of the first embodiment in FIG. 1 are given the same reference codes.

The control circuit of the image formation apparatus according to the second embodiment includes: image drum unit having the same configuration as that of the first embodiment; and developer discard amount controller 50A having a different configuration from that of the first embodiment.

Developer discard amount controller 50A of the second embodiment includes: development roller power unit 32; first controller 51; exposure amount controller 52 as a light amount change unit; second controller 53; rotation number measurement unit 54; image dot number measurement unit 55; dot number calculation unit 56; and dot number comparison unit 57, which are the same as those of the first embodiment. Developer discard amount controller 50A also includes storage unit 58A having a different configuration and function from that of the first embodiment.

Storage unit 58 of the first embodiment has table 58*a* shown in FIG. 3, whereas storage unit 58A of the second embodiment has table 58*b* shown in FIG. 9. The configuration of the image formation apparatus of the second embodiment is the same as that of the first embodiment except for storage unit 58A.

FIG. 9 is a chart showing an example of table 58*b* in FIG. 8, and shows: rotation measurement value Rf determined based on total number of rotations N of the drum; and development voltage Vf changed along with a change of rotation measurement value Rf.

Rotation measurement values Rf in FIG. 9 have a magnitude relation of Rf1<Rf2<Rf3<Rf4<Rf5<Rf6<Rf7. Development voltages Vf in FIG. 9 have a magnitude relation of Vf7<Vf6<Vf5<Vf4<Vf3<Vf2<Vf1. A setting is made in such a manner that, as rotation measurement value Rf, determined based on total number of rotations N of the drum, becomes larger, development voltage Vf becomes smaller. Rotation measurement value Rf in FIG. 9 has seven levels, i.e., Rf1 to Rf7, but in practical use, rotation measurement value Rf has multiple levels corresponding to total number of rotations N of the drum. The same applies for development voltage Vf.

(Operation of Second Embodiment)

An image formation operation of the second embodiment is the same as that of the first embodiment, and thus its description is omitted. Hereinbelow, an operation of toner discard processing of the second embodiment is described.

Figure 10:
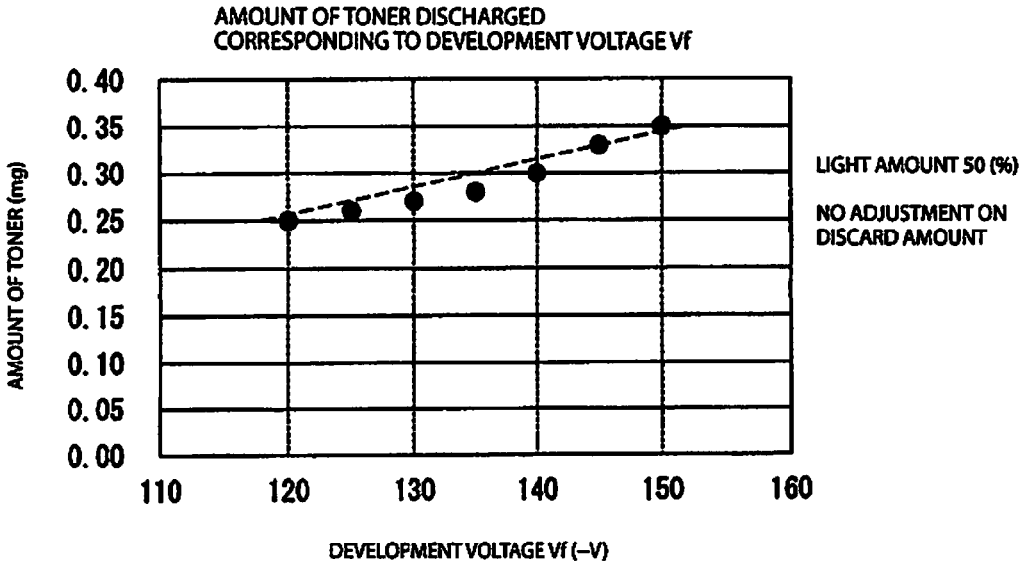
FIG. 10 is a graph showing a measurement result of the amount of toner discharged on a photosensitive drum in one toner discard operation when development voltage Vf is changed.

FIG. 10 is a graph showing a measurement result of the amount of toner discharged on photosensitive drum 21 in one toner discard operation when development voltage Vf is changed.

The horizontal axis indicates development voltage Vf (−V) applied to development roller 24, and the vertical axis indicates the amount of toner (mg) discharged on photosensitive drum 21 in the toner discard operation.

The graph shows that the smaller development voltage Vf is, the smaller the amount of toner discharged in one toner discard operation is. In this way, setting development voltage Vf smaller makes it possible to reduce the amount of toner discharged on photosensitive drum 21 in one toner discard operation because this reduces a potential difference between an electrostatic latent image on photosensitive drum 21 and development roller 24.

In the second embodiment, development voltage Vf corresponding to total number of rotations N of photosensitive drum 21 is set in the toner discard operation, thereby adjusting the amount of toner discarded which increases in proportion to total number of rotations N of the drum.

With reference to FIGS. 4, 5, and 10, a description is given here of how to obtain rotation measurement value Rf and development voltage Vf associated with rotation measurement value Rf in table 58*b* in FIG. 8 shown in FIG. 9, which are determined by total number of rotations N of photosensitive drum 21.

In FIG. 9, when total number of rotations N of photosensitive drum 21 is 15 (K)=15,000, Rf=Rf4 and Vf=Vf4. In FIG. 4, when total number of rotations N of photosensitive drum 21 is 15 (K), the amount of toner discharged in one discard operation in the case where no adjustment is made to the discard amount ((1) ●) is 0.28 (mg). As compared with the case where the amount of toner to be discharged is adjusted to a constant amount of 0.25 mg ((2) ○), which has no difference from the case of no adjustment ((1) ●) in print image quality, it shows that toner α is discarded excessively in the case of no adjustment ((1) ●) by the amount (per discard operation) equal to:

$$0.28\ (\text{mg})-0.25\ (\text{mg})=0.03\ (\text{mg}).$$

For instance, assuming that light amount Lf of irradiation light from exposure device 23 and development voltage Vf in the case of no adjustment ((1) ●) in FIG. 4 are 50(%) and −150 (V), it can be understood from FIG. 10 that the amount of toner to be discharged in one discard operation can be adjusted to be smaller by 0.03 (mg) by lowering development voltage Vf from 150 (−V) to 140 (−V). To put it differently, a reducible amount of toner, which is discharged excessively, in certain total number of rotations N of photosensitive drum 21 is obtained from FIG. 4, and then a value of development voltage Vf (−V) needed for toner reduction by the obtained reducible amount is obtained from FIG. 10.

As described above, development voltage Vf (−V) corresponding to total number of rotations N of photosensitive drum 21 (K) is obtained and stored in table 58*b* of FIG. 9 in advance. Then, in the toner discard operation, development voltage Vf (−V) associated with a certain total number of rotations N of photosensitive drum 21 (K) is read from the table, and a development voltage outputted from development roller power unit 32 is controlled so that the development voltage may become equal to the read development voltage Vf (−V). Thereby, the amount of toner discharged excessively can be reduced while the print image quality in this case is kept equal to that in the case where the amount of toner to be discharged is not adjusted.

Figure 11:
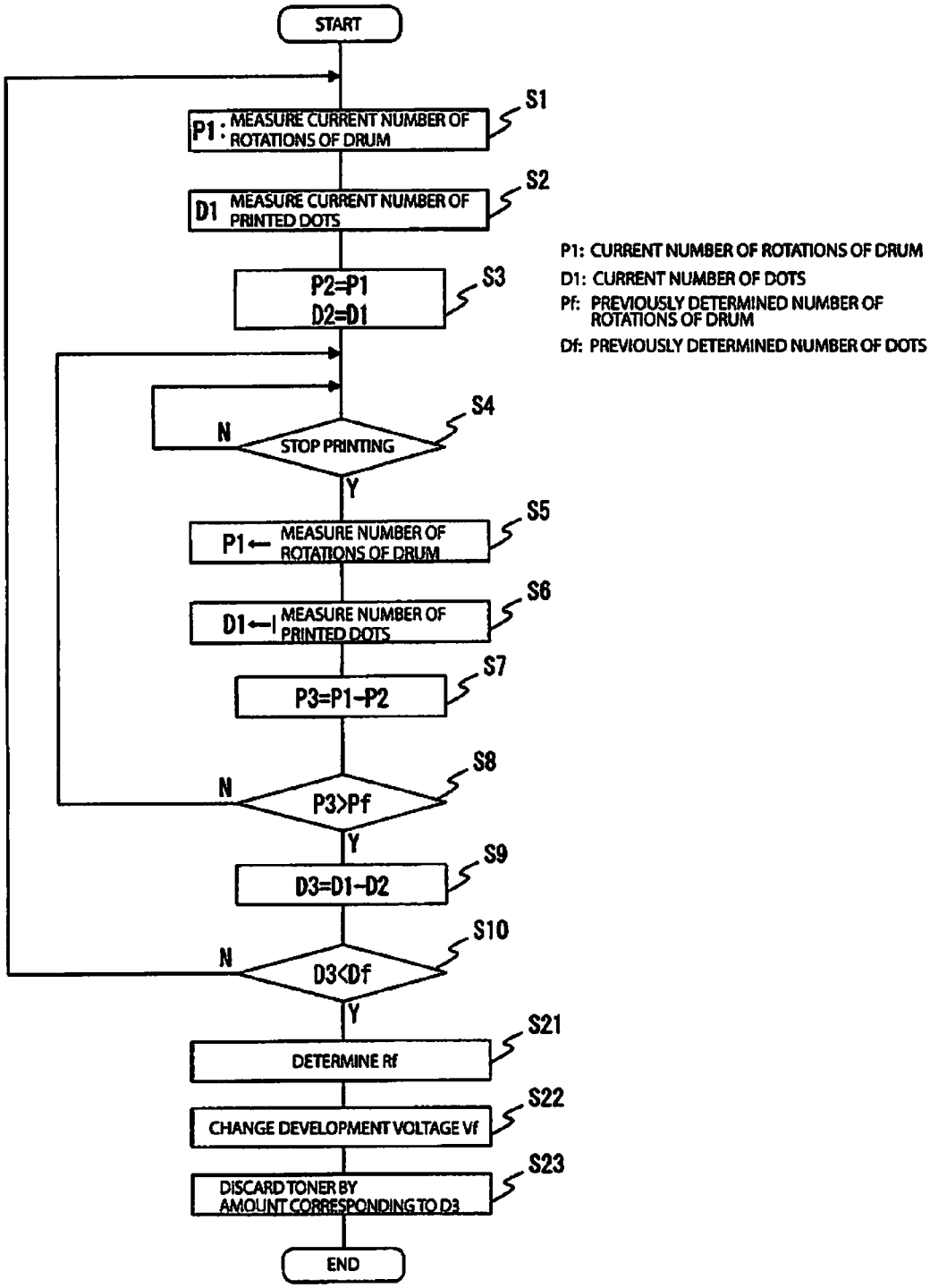
FIG. 11 is a flowchart showing image formation processing and toner discard processing by the control circuit shown in FIG. 8 of the image formation apparatus.

FIG. 11 is a flowchart showing the image formation processing and the toner discard processing in the image formation apparatus of FIG. 8. Components in FIG. 11 which are the same as those of FIG. 7 showing the image formation processing and the toner discard processing of the first embodiment are given the same reference codes. In FIG. 11, Step S10 indicates image dot number judgment processing, Steps S21 and S22 indicate developer discard amount adjustment processing, and Step S23 indicates developer discard processing.

By using the flowchart of FIG. 11, an operation of the toner discard processing is described with reference to FIG. 2 and FIGS. 8 to 10.

Once the processing of the second embodiment is started, the process moves to Step S1. The processing in Steps S1 to S9 which are the same as those of the first embodiment is carried out, and then the process moves to Step S10. In Step S10, dot number comparison unit 57 compares the magnitude of the number of image dots from the start to the stop of printing D3 with that of number of image dots Df previously stored in storage unit 58A. If the number of image dots from the start to the stop of printing D3 is smaller than a previously stored number of image dots Df (Y), the process moves to Step S21. If the number of image dots from the start to the stop of printing D3 is equal to or larger than the previously stored number of image dots Df (N), the process goes back to Step S1.

Here, the above description means that, if D3<Df, the toner discard operation is carried out in Steps S21 to S23, and if D3≥Df, the processing in Steps S1 to S10 is repeated, i.e., only the image formation processing is carried out and no toner discard operation is carried out.

In Step S21, second controller 53 receives the current number of rotations P1 of photosensitive drum 21 by referring to table 58*b* stored in storage unit 58A and determines rotation measurement value Rf associated with the current number of rotations P1 of photosensitive drum 21, and the process moves to Step S22. In Step S22, second controller 53 determines development voltage Vf associated with rotation measurement value Rf determined in Step S21. Development voltage Vf thus determined is inputted in development roller power unit 32, and the process moves to Step S23. In Step S23, second controller 53 adjusts the amount of toner on development roller 24 to be forcibly attached to photosensitive drum 21, on the basis of total number of rotations N of photosensitive drum 21 by means of development voltage Vf determined in Step S22, and carries out the toner discard operation in which the adjusted amount of toner α to be discharged is forcibly attached to photosensitive drum 21. Thus, the process is terminated.

(Effect of Second Embodiment)

According to the image formation apparatus and the method of adjusting a developer discard amount for the same in the second embodiment, in the toner discard operation, development voltage Vf to be applied to development roller 24 is changed on the basis of total number of rotations N of photosensitive drum 21, and thereby the amount of toner on development roller 24 to be forcibly attached to photosensitive drum 21 and discarded is adjusted. With the apparatus and method, no toner is discarded excessively, and thus it is possible to reduce the amount of toner to be discarded while maintaining good print image quality. Besides, the amount of toner filled in image drum unit 20 prior to shipment of the unit (or image formation apparatus) can be reduced, and the cost of manufacture of image drum unit 20 can be reduced by this toner reduction.

Modified Examples

The invention is not limited to the first and second embodiments described above, but various usage patterns and modified examples may be employed. Such various usage patterns and modified examples include the following (a) to (c), for example.

(a) The image formation apparatus described in the first and second embodiments is a printer; however, the invention is also applicable to MFPs, facsimile apparatuses, and copiers.

(b) The values in tables 58*a* and 58*b* previously stored in storage units 58 and 58A are described as having seven levels in the first and second embodiments; however, any table modified as appropriate may be employed without being limited to the seven levels.

(c) The description in the first and second embodiments states that light amount Lf of irradiation light to be emitted from exposure device 23 and development voltage Vf to be applied to development roller 24 are controlled in order to adjust the amount of toner on development roller 24 to be forcibly attached to photosensitive drum 21 in the discard operation. However, the method of adjusting the amount of toner on development roller 24 to be attached to photosensitive drum 21 is not limited to these methods. For example, the same effect can be achieved with a method in which the amount of electric charges in an electrostatic latent image is controlled by adjusting a charging voltage to be applied to charging roller 22.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation apparatus comprising:

a rotatable image carrier configured to carry an electrostatic latent image;

an exposure unit configured to form the electrostatic latent image with a certain number of image dots by exposing the image carrier to irradiation light;

a development unit configured to form a developer image by attaching a developer to the electrostatic latent image with a development voltage;

a voltage supply unit configured to supply the development unit with the development voltage;

an image formation unit configured to transfer the developer image onto a recording medium;

a cleaning unit configured to cleanup the developer left on the image carrier after the transfer of the developer image; and a developer discard amount controller configured to control an amount of the developer to be forcibly attached to the image carrier from the development unit on the basis of a total number of rotations of the image carrier if the number of image dots printed during a prescribed number of rotations of the image carrier is smaller than a reference value, and to forcibly attach a controlled amount of the developer to the image carrier to discard the developer.

2. The image formation apparatus according to claim 1, wherein the developer discard amount controller reduces the amount of developer to be forcibly attached to the image carrier as the total number of rotations of the image carrier increases.

3. The image formation apparatus according to claim 1, further comprising an exposure amount controller configured to change an amount of the irradiation light from the exposure unit, wherein the developer discard amount controller includes:

the voltage supply unit;

a first controller configured to control the exposure amount controller and a rotation operation of the image carrier;

the exposure amount controller;

a rotation number measurement unit configured to measure the total number of rotations of the image carrier and to output a rotation measurement value thus measured;

an image dot number measurement unit configured to measure the number of image dots exposed by the exposure unit and to output a dot measurement value thus measured;

a dot number calculation unit configured to calculate the number of image dots printed during the prescribed number of rotations from the rotation measurement value and the dot measurement value and to output a dot number calculation result;

a dot number comparison unit configured to compare the dot number calculation result with the reference value being a predetermined number of image dots corresponding to the prescribed number of rotations of the image carrier and to output a comparison result; and a second controller configured to control an overall operation of the voltage supply unit, the first controller, the exposure amount controller, the rotation number measurement unit, the image dot number measurement unit, the dot number calculation unit, and the dot number comparison unit, and the developer discard amount controller controls the amount of developer on the development unit to be forcibly attached to the image carrier on the basis of the total number of rotations if the comparison result shows that the dot number calculation result is smaller than the predetermined reference value, and forcibly attaches the controlled amount of developer to the image carrier to discard the developer.

4. The image formation apparatus according to claim 3, wherein the second controller controls the exposure amount controller by way of the first controller in such a way that the light amount of the irradiation light is changed based on the total number of rotations of the image carrier.

5. The image formation apparatus according to claim 3, wherein the second controller controls the voltage supply unit in such a way that the development voltage is changed based on the total number of rotations of the image carrier.

6. The image formation apparatus according to claim 3, wherein the developer discard amount controller further includes a storage unit configured to store therein a first table having the rotation measurement value and the light amount corresponding to an amount of developer to be discarded which is determined as reducible according to the rotation measurement value, and when discarding the developer, the developer discard amount controller reads the light amount according to the rotation measurement value from the first table and controls the exposure amount controller in such a way that the light amount from the exposure unit is changed to the read light amount.

7. The image formation apparatus according to claim 3, wherein the developer discard amount controller further includes a storage unit configured to store therein a second table having the rotation measurement value and the development voltage corresponding to an amount of developer to be discarded which is determined as reducible according to the rotation measurement value, and when discarding the developer, the developer discard amount controller reads the development voltage according to the rotation measurement value from the second table and controls the voltage supply unit in such a way that the development voltage is changed to the read development voltage.

8. A method of adjusting a developer discard amount for an image formation apparatus comprising:

forming an electrostatic latent image on an image carrier with a certain number of image dots by exposing the image carrier to irradiation light;

forming a developer image by attaching a developer to the electrostatic latent image with a development voltage;

transferring the developer image onto a recording medium;

cleaning up the excess developer left on the image carrier after the transfer of the developer image; and controlling an amount of the developer to be forcibly attached to the image carrier, wherein said controlling comprises:

an image dot number judgment step of judging whether or not a number of image dots printed during a prescribed number of rotations of the image carrier is smaller than a reference value;

a developer discard amount adjustment step of adjusting an amount of the developer to be forcibly attached to the image carrier from the development unit on the basis of a total number of rotations of the image carrier if a result of the image dot number judgment step is smaller than the reference value; and a developer discard step of discarding the developer in the amount of the developer adjusted in the developer discard amount adjustment step by forcibly attaching the developer to the image carrier.

9. The method according to claim 8, wherein the developer discard amount adjustment step controls the amount of the irradiation light based on the total number of rotations of the image carrier.

10. The method according to claim 8, wherein the developer discard amount adjustment step controls the development voltage based on the total number of rotations of the image carrier.

* * * * *